US005947095A

United States Patent [19]

Kato

[11] Patent Number: 5,947,095

[45] Date of Patent: Sep. 7, 1999

[54] CYLINDER-BY-CYLINDER AIR-FUEL RATIO-ESTIMATING SYSTEM FOR INTERNAL COMBUSTION ENGINES

[75] Inventor: Akira Kato, Wako, Japan

[73] Assignee: Honda Giken Kogyo Kabushiki Kaisha, Tokyo, Japan

[21] Appl. No.: 08/900,876

[22] Filed: Jul. 25, 1997

[30] Foreign Application Priority Data

Aug. 1, 1996 [JP] Japan ..... 8-218145

[51] Int. Cl.[6] ..... F02D 41/14

[52] U.S. Cl. ..... 123/673; 123/481; 123/679

[58] Field of Search ..... 123/673, 481, 123/679

[56] References Cited

U.S. PATENT DOCUMENTS

| | | | |
|---|---|---|---|
| 4,934,328 | 6/1990 | Ishii et al. | 123/673 |
| 5,126,943 | 6/1992 | Nakaniwa | 123/690 |
| 5,651,353 | 7/1997 | Allston | 123/673 |
| 5,673,676 | 10/1997 | Mukumoto | 123/673 |
| 5,781,875 | 7/1998 | Maki et al. | 123/673 |

FOREIGN PATENT DOCUMENTS 6-173755 6/1994 Japan .

*Primary Examiner*—Erick R. Solis

*Attorney, Agent, or Firm*—Nikaido, Marmelstein, Murray & Oram LLP

[57] ABSTRACT

A cylinder-by-cylinder air-fuel ratio-estimating system for an internal combustion engine includes an air-fuel ratio sensor arranged in the exhaust system of the engine. The air-fuel ratio of a mixture supplied to each of the cylinders of the engine is estimated based on an output from the air-fuel ratio sensor, by using an observer for observing the internal operative state of the exhaust system based on a model representative of the behavior of the exhaust system. The estimated air-fuel ratio of the mixture supplied to each of the cylinders is initialized to a value corresponding to the output from the air-fuel ratio sensor, depending upon operating conditions of the engine.

7 Claims, 15 Drawing Sheets

ECU5
33
32
30
60
15
31
20
19
16
18
O2
LAF
17
23
22
5
ECU
IG
14
1
TW
13
ECU5
12
11
PBA
10
9
3
4
θTH
7
6
2
TA
8
21
PA

NE
PBA
θTH
PA
B1
TIMF
B2
B3
B4
B5
B6
B7
B8
B9
KTOTAL
KCMDM
TOUT
TOUT
TOUT
TOUT
1
ENG
KOBSV#1
KOBSV#3
KOBSV#4
KOBSV#2
B12
B14
B15
B13
PID
PID
PID
PID
B11
OBSV
KLAF
KLAF
KCMD
B18
PID
B16
LPF
B10
SELV
22
LPF
17
LAF
19
CAT
20
CAT
18
O2
23
LPF
B21
KCMD
B22
MIDO2 FB
KCMD
B23
KCMDM

FIG.4A
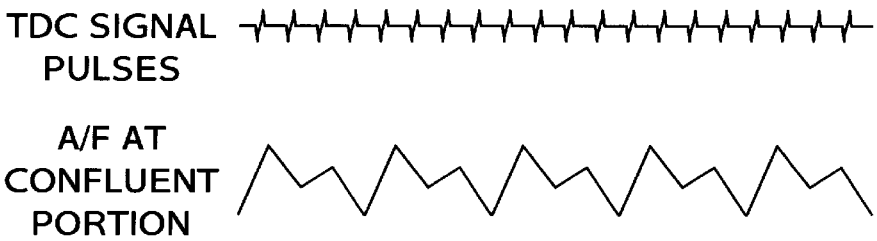
FIG.4B
FIG.5A
FIG.5B
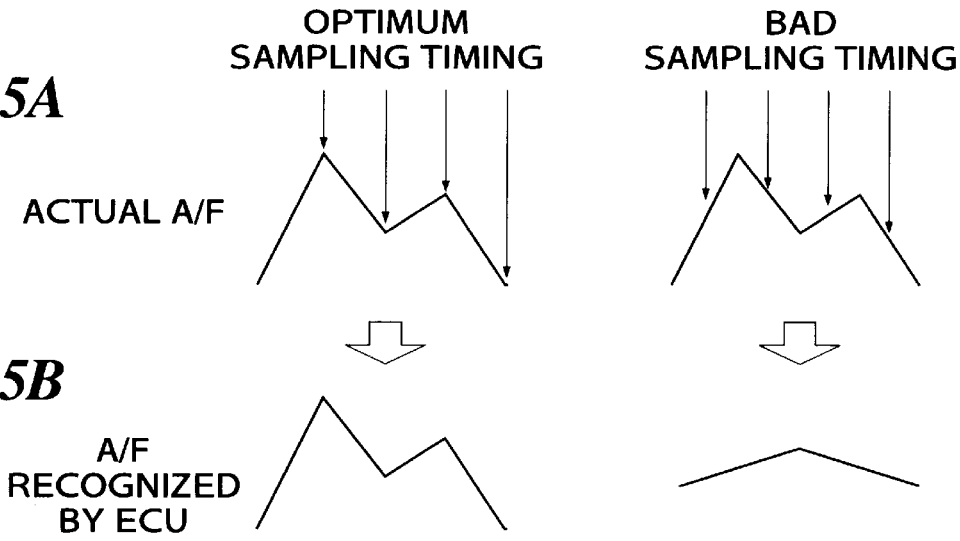

CYLINDER-BY-CYLINDER AIR-FUEL RATIO-ESTIMATING SYSTEM FOR INTERNAL COMBUSTION ENGINES

BACKGROUND OF THE INVENTION

1. Field of the Invention

This invention relates to a cylinder-by-cylinder air-fuel ratio-estimating system for internal combustion engines, which estimates the air-fuel ratio of a mixture supplied to each of cylinders of the engine by applying an observer based on a modern control theory.

2. Prior Art

Conventionally, there is known a cylinder-by-cylinder air-fuel ratio-estimating system for internal combustion engines, for example, from Japanese Laid-Open Patent Publication (Kokai) No. 6-173755, which sets an observer for observing the internal operative state of the exhaust system of the engine, based on a model describing the behavior of the exhaust system, and estimates the air-fuel ratio of a mixture supplied to each of cylinders of the engine (cylinder-by-cylinder air-fuel ratio), based on an output from an air-fuel ratio sensor arranged in the exhaust system at a confluent portion thereof, for generating an output proportional to the air-fuel ratio.

According to the known cylinder-by-cylinder air-fuel ratio-estimating system, in view of the fact that a large change occurs in the cylinder-by-cylinder air-fuel ratio estimated by the observer, e.g. when the internal combustion engine is in a transient operating condition, the estimated cylinder-by-cylinder air-fuel ratio is initialized to a value corresponding to a stoichiometric air-fuel ratio when the estimated air-fuel ratio falls outside a range between predetermined upper and lower limit values.

According to the above manner of initialization of the cylinder-by-cylinder air-fuel ratio, the estimated cylinder-by-cylinder air-fuel ratio is initialized to a value corresponding to the stoichiometric air-fuel ratio when the engine is in a transient operating condition, such as when the cylinder-by-cylinder air-fuel ratio feedback control is started, or when the engine is in a condition immediately after a fuel-cut state (the fuel supply has just been resumed). This, however, can cause a delay in the convergence of the observer output (estimated cylinder-by-cylinder air-fuel ratio). As a result, the actual cylinder-by-cylinder air-fuel ratio, which is obtained based on results of the air-fuel ratio feedback control by the use of the observer output, can deviate from a desired air-fuel ratio.

SUMMARY OF THE INVENTION

It is the object of the invention to provide a cylinder-by-cylinder air-fuel ratio-estimating system for internal combustion engines, which is capable of properly initializing the estimated cylinder-by-cylinder air-fuel ratio of a mixture supplied to each cylinder, in such a manner as to improve the converging speed of the observer output when the engine is in a transient operating condition, such as when the cylinder-by-cylinder air-fuel ratio feedback control is started.

To attain the object, the present invention provides a cylinder-by-cylinder air-fuel ratio-estimating system for an internal combustion engine having a plurality of cylinders, and an exhaust system, the cylinder-by-cylinder air-fuel ratio-estimating system including air-fuel ratio-detecting means arranged in the exhaust system, and cylinder-by-cylinder air-fuel ratio-estimating means for estimating an air-fuel ratio of a mixture supplied to each of the cylinders, based on an output from the air-fuel ratio-detecting means, by using an observer for observing an internal operative state of the exhaust system based on a model representative of a behavior of the exhaust system.

The cylinder-by-cylinder air-fuel ratio-estimating system is characterized by an improvement wherein:

the cylinder-by-cylinder air-fuel ratio-estimating means includes first initializing means for initializing the air-fuel ratio of the mixture supplied to the each of the cylinders estimated by the cylinder-by-cylinder air-fuel ratio-estimating means to a value corresponding to the output from the air-fuel ratio-detecting means, depending upon operating conditions of the engine.

Preferably, the air-fuel ratio-detecting means is arranged at the confluent portion of the exhaust system.

More preferably, the cylinder-by-cylinder air-fuel ratio-estimating means includes confluent portion air-fuel ratio-estimating means for estimating an air-fuel ratio at the confluent portion of the exhaust system by using a delay parameter representative of a response delay of the air-fuel ratio-detecting means, the confluent portion air-fuel ratio-estimating means including second initializing means for initializing the air-fuel ratio at the confluent portion estimated by the confluent portion air-fuel ratio-estimating means to a value corresponding to the output from the air-fuel ratio-detecting means, depending upon the operating conditions of the engine.

Preferably, the first and second initializing means are operable when the engine is in a predetermined transient operating condition.

More preferably, the predetermined transient condition of the engine is an operating condition in which cylinder-by-cylinder air-fuel ratio feedback control is started, the cylinder-by-cylinder air-fuel ratio feedback control feedback-controlling the air-fuel ratio of the mixture supplied to the each of the cylinders to a desired air-fuel ratio, based on the air-fuel ratio of the mixture supplied to the each of the cylinders estimated by the cylinder-by-cylinder air-fuel ratio-estimating means and the air-fuel ratio at the confluent portion estimated by the confluent portion air-fuel ratio-estimating means.

Also preferably, the predetermined transient operating condition of the engine is an operating condition in which the engine has shifted to a fuel-cut state or has returned from the fuel-cut state.

Also preferably, the predetermined transient operating condition of the engine is an operating condition in which the engine has shifted to an idling condition or has shifted from the idling condition to a condition other than the idling condition.

The above and other objects, features, and advantages of the invention will become more apparent from the following detailed description taken in conjunction with the accompanying drawings.

BRIEF DESCRIPTION OF THE DRAWINGS

FIGS. 4A and 4B collectively form a timing chart showing the relationship between TDC signal pulses obtained from a multi-cylinder internal combustion engine and the air-fuel ratio detected at a confluent portion of the exhaust system of the engine, in which:

FIG. 4A shows TDC signal pulses obtained from the engine; and

FIG. 4B shows the air-fuel ratio detected at the confluent portion of the exhaust system;

FIG. 5A and FIG. 5B show good and bad examples of timing of sampling an output from the LAF sensor, in which;

FIG. 5A shows examples of the sampling timing in relation to the actual air-fuel ratio; and FIG. 5B shows examples of the air-fuel ratio recognized by an ECU through sampling of the output from the LAF sensor;

DETAILED DESCRIPTION

The invention will now be described in detail with reference to the drawings showing an embodiment thereof.

Figure 1:
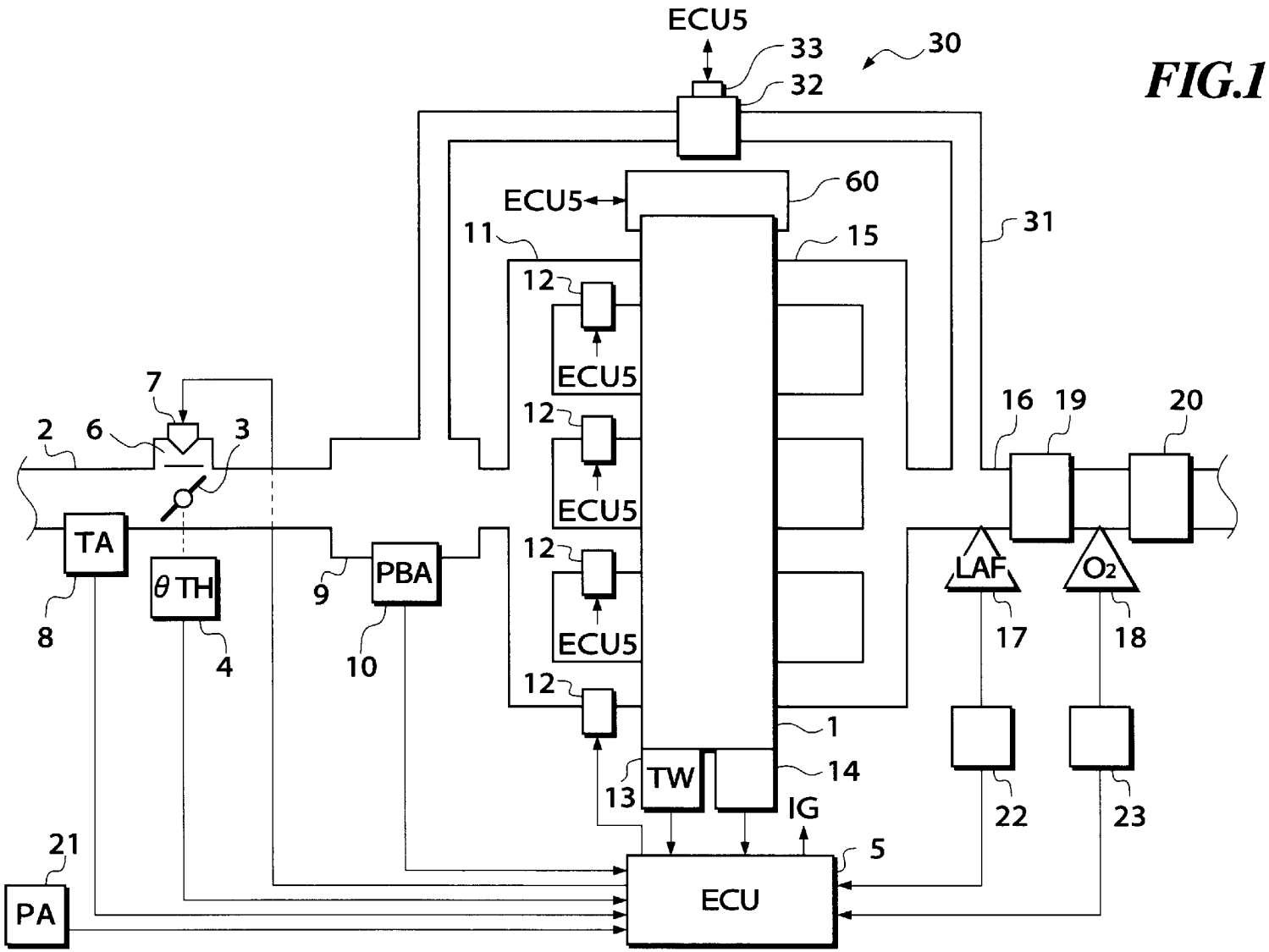
FIG. 1 is a block diagram showing the arrangement of an internal combustion engine incorporating an air-fuel ratio control system therefor, including a cylinder-by-cylinder air-fuel ratio-estimating system according to a first embodiment of the invention.

Referring first to FIG. 1, there is schematically shown the whole arrangement of an internal combustion engine and a control system therefor, including a cylinder-by-cylinder air-fuel ratio-estimating system according to a first embodiment of the invention. In the figure, reference numeral 1 designates a four-cylinder type internal combustion engine (hereinafter simply referred to as "the engine") having a pair of intake valves and a pair of exhaust valves provided for each cylinder, neither of which are shown.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as a fuel injection timing and an ignition timing, and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. In the present embodiment, the engine is of the 4-cylinder type and includes the single LAF sensor 17, which, however, is not limitative. When a V-type internal combustion engine is employed, the LAF sensor may be provided for each of the confluent portions of banks in the exhaust system. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 32 and supplying a signal indicative of the detected valve lift to the ECU 5. The EGR valve 32 is an electromagnetic valve having a solenoid which is electrically connected to the ECU 5, the valve lift of which is linearly changed by a control signal from the ECU 5.

The engine 1 includes a valve timing changeover mechanism 60 which changes valve timing of the intake valves and exhaust valves between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on the results of the calculation:

$$TOUT(N)=TIMF\times KTOTAL\times KCMDM\times KLAF\times KOBSV\#N \quad \ldots (1)$$

where TIMF represents a basic value of the fuel injection amount TOUT(N), KTOTAL a correction coefficient, KCMDM a final desired air-fuel ratio coefficient, KLAF a PID correction coefficient, and KOBSV#N a cylinder-by-cylinder correction coefficient, respectively.

Figure 2:
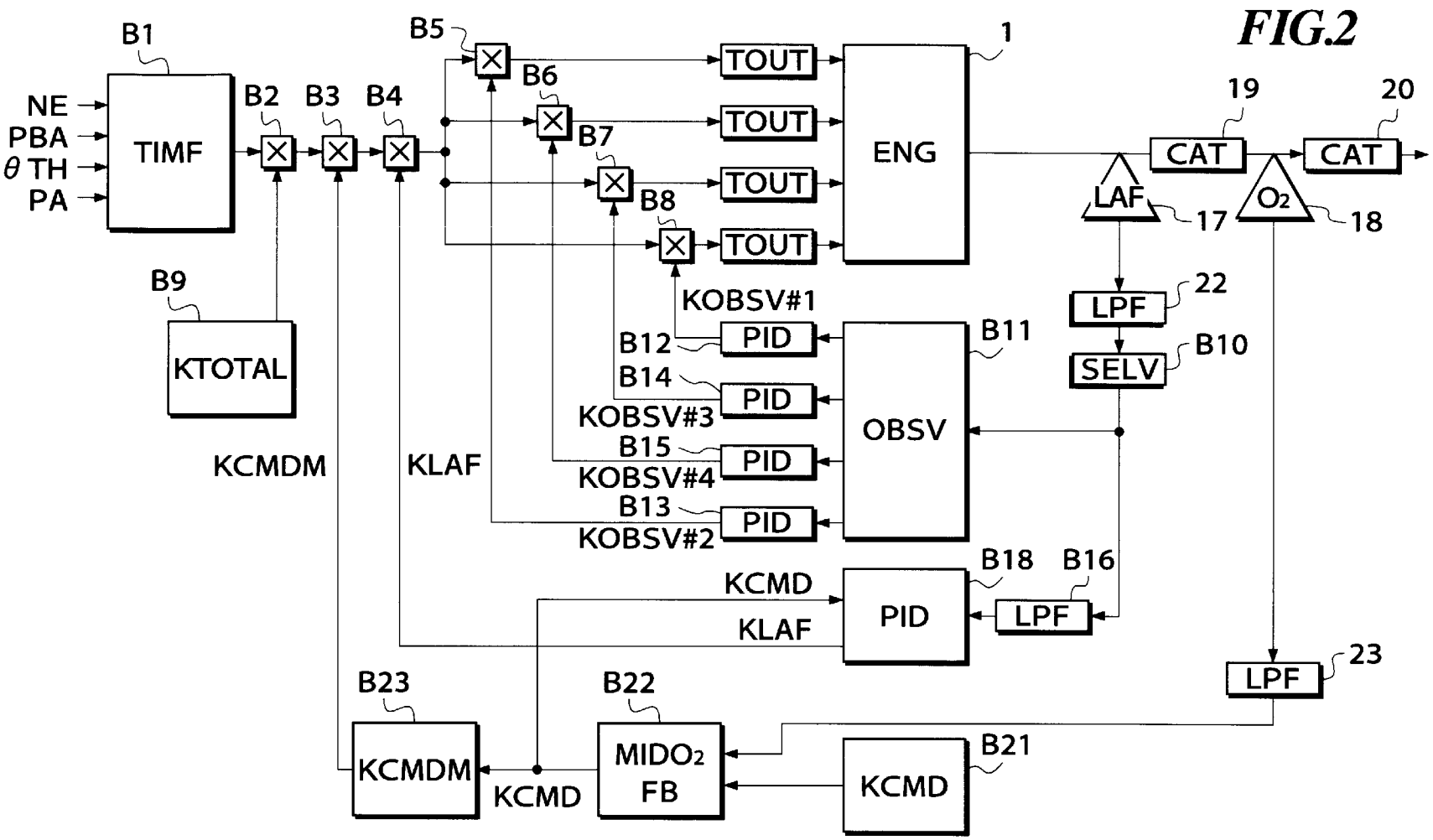
FIG. 2 is a block diagram useful in explaining a manner of controlling the air-fuel ratio of a mixture supplied to the engine.

FIG. 2 is a block diagram useful in explaining a manner of calculating the fuel injection period TOUT(N) by the use of the equation (1). With reference to the figure, an outline of the manner of calculating the fuel injection period TOUT (N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B8 designate multiplying blocks, which multiply the basic fuel amount TIMF by respective parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to blocks B18 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates the PID correction coefficient KLAF through PID control, based on the difference between the actual air-fuel ratio and the desired air-fuel ratio and supplies the KLAF value to the block B4.

The block B11 has the function of a so-called observer, i.e. a function of estimating a value of the air-fuel ratio separately for each cylinder from the air-fuel ratio (of a mixture of exhaust gases emitted from the cylinders) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B5 to B8, respectively.

As described above, in the present embodiment, the fuel injection amount TOUT(N) is calculated cylinder by cylinder by applying to the equation (1) the PID correction coefficient KLAF which is calculated by the ordinary PID control according to the output from the LAF sensor 17, as well as applying to the same equation the cylinder-by-cylinder correction coefficient KOBSV#N which is set according to the air-fuel ratio of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence obtain good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
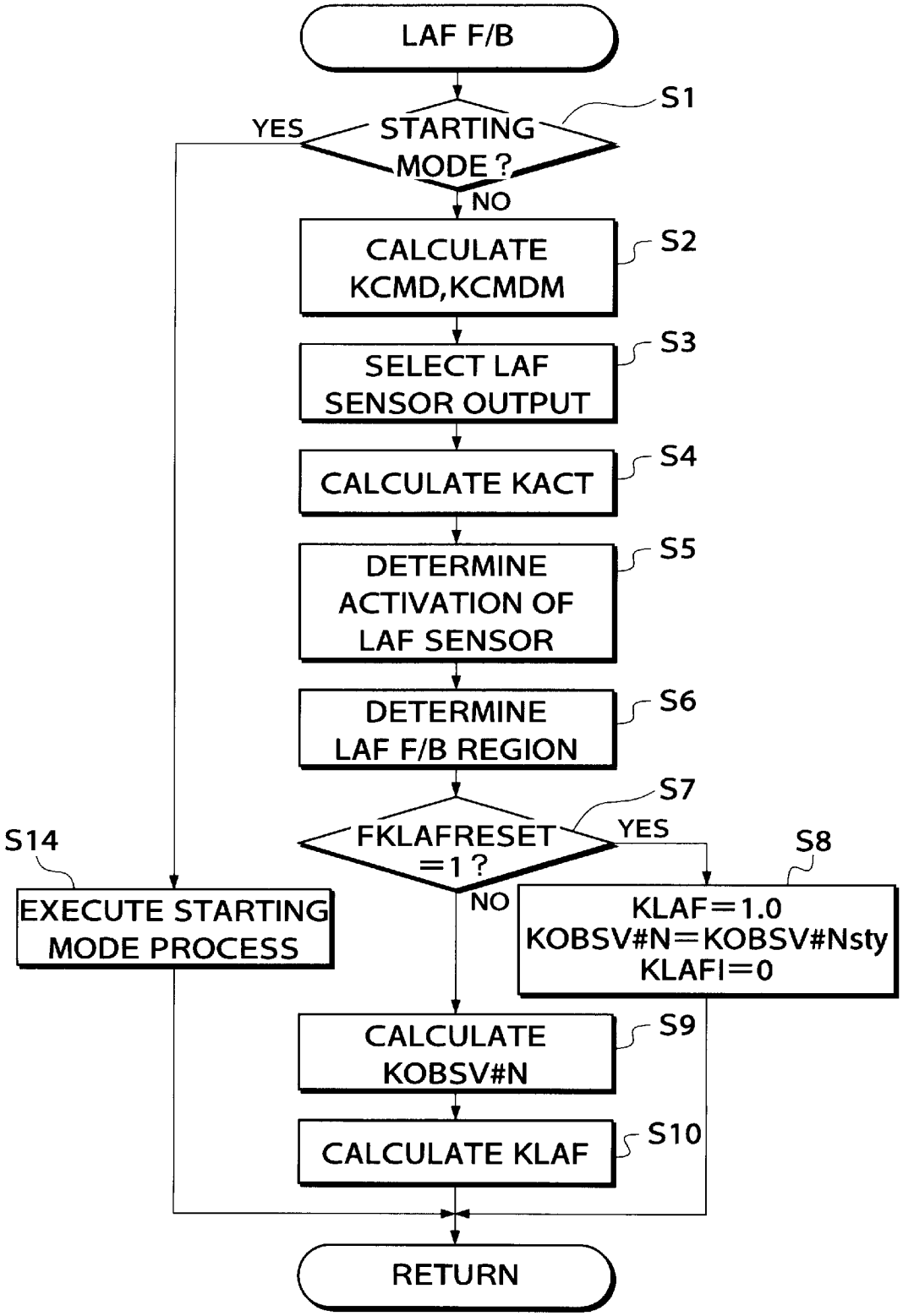
FIG. 3 is a flowchart showing a main routine for calculating a PID correction coefficient KLAF and a cylinder-by-cylinder correction coefficient KOBSV#N in response to an output from a LAF sensor appearing in FIG. 1.

FIG. 3 shows a main routine for calculating the PID correction coefficient KLAF and the cylinder-by-cylinder correction coefficient KOBSV#N according to the output from the LAF sensor 17. This routine is executed in synchronism with generation of TDC signal pulses.

At a step S1, it is determined whether or not the engine is in starting mode, i.e. whether or not the engine is cranking. If the engine is in the starting mode, the program proceeds to a step S14 to execute a subroutine for the starting mode, not shown. If the engine is not in the starting mode, the desired air-fuel ratio coefficient (desired equivalent ratio) KCMD and the final desired air-fuel ratio coefficient KCMDM are calculated depending on the engine operating conditions at a step S2, and the LAF sensor output-selecting process is executed at a step S3. Further, an actual equivalent ratio KACT depending on the output from the LAF sensor is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF is set to "1.0", the cylinder-by-cylinder correction coefficient KOBSV#N is set to a learned value KOBSV#Nsty thereof, referred to hereinafter, and an integral term KLAFI used in the PID control is set to "0", followed by terminating the program. By setting the cylinder-by-cylinder correction coefficient KOBSV#N to the learned value KOBSV#Nsty thereof, it is possible to prevent a misfire of the engine ascribable to changes in the mechanical parts of the fuel supply system due to aging, as well as ensure required stability of the engine operation during the feedforward control against undesired fluctuations in the rotation of the engine.

On the other hand, if FKLAFRESET=0 holds at the step S7, the cylinder-by-cylinder correction coefficient KOBSV#N and the PID correction coefficient KLAF are calculated at respective steps S9 and S10, followed by terminating the present routine.

The PID correction coefficient KLAF is calculated according to the difference between the actual equivalent ratio KACT and the desired air-fuel ratio coefficient (desired equivalent ratio) KCMD in a well-known PID control method.

Next, the LAF sensor output-selecting process executed at the step S3 in FIG. 3 will be described.

Exhaust gases are emitted from the engine on the exhaust stroke, and accordingly, clearly the behavior of the air-fuel ratio detected at the confluent portion of the exhaust system of the multi-cylinder engine is synchronous with generation of TDC signal pulses. Therefore, detection of the air-fuel ratio by the LAF sensor 17 is also required to be carried out in synchronism with generation of TDC signal pulses. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 4B in comparison with timing of generation of each TDC signal pulse shown in FIG. 4A, the air-fuel ratio recognized by the ECU 5 can have quite different values depending on the timing of sampling, as shown in FIG. 5B. Therefore, it is desirable that the sampling of the output from the LAF sensor 17 should be carried out at such timing as enables the ECU 5 to recognize actual variation in the sensor output as accurately as possible.

Further, the variation in the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of TDC signal pulses is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 6:
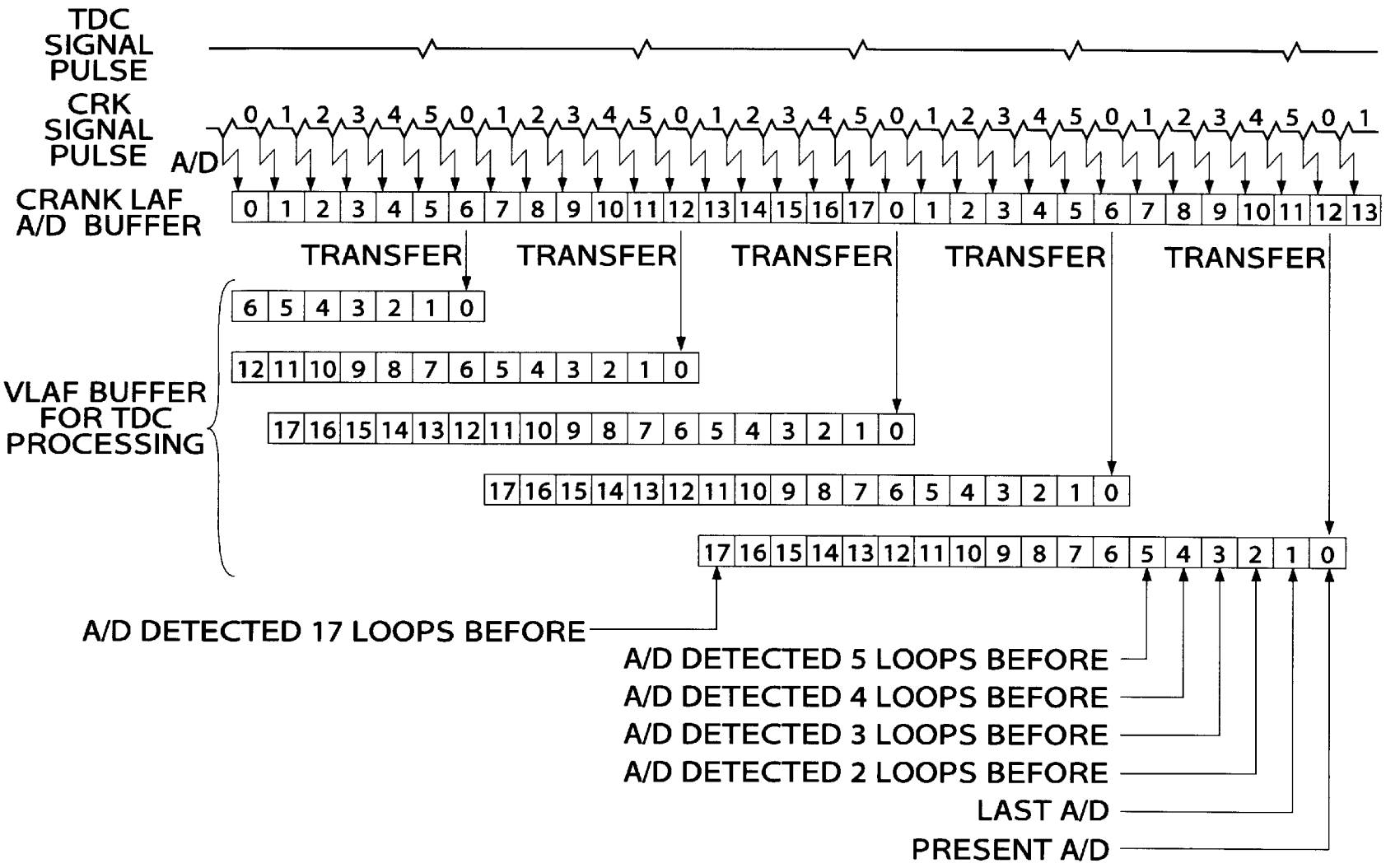
FIG. 6 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 6, values of the output from the LAF sensor 17 sampled in synchronism with generation of CRK signal pulses (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 7:
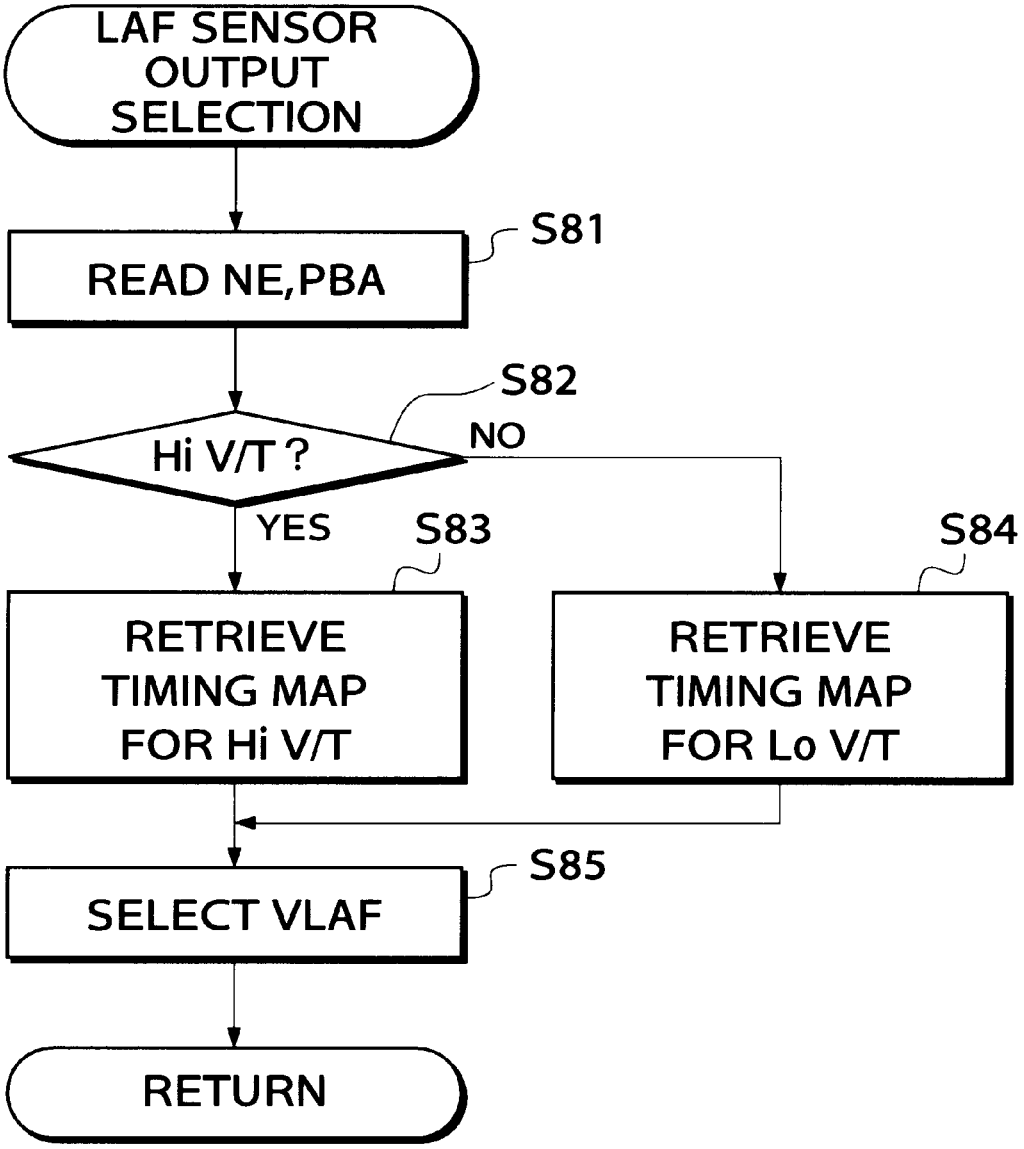
FIG. 7 is a flowchart showing a subroutine for selecting a value of the output from the LAF sensor (LAF sensor output value), which is executed at a step S3 in FIG. 3.

FIG. 7 shows a subroutine for carrying out the LAF sensor output-selecting process, which is executed at the step S3 in FIG. 3.

First, at a step S81, the engine rotational speed NE and the intake pipe absolute pressure PBA are read from the respective sensor outputs, and then it is determined at a step S82 whether or not the present valve timing is set to the high-speed valve timing. If the present valve timing is set to the high-speed valve timing, a timing map suitable for the high-speed valve timing is retrieved at a step S83, whereas if the same is set to the low-speed valve timing, a timing map suitable for the low-speed valve timing is retrieved at a step S84. Then, one of the LAF sensor output values VLAF stored in the ring buffer is selected according to the result of the retrieval at a step S85, followed by terminating the program.

Figure 8:
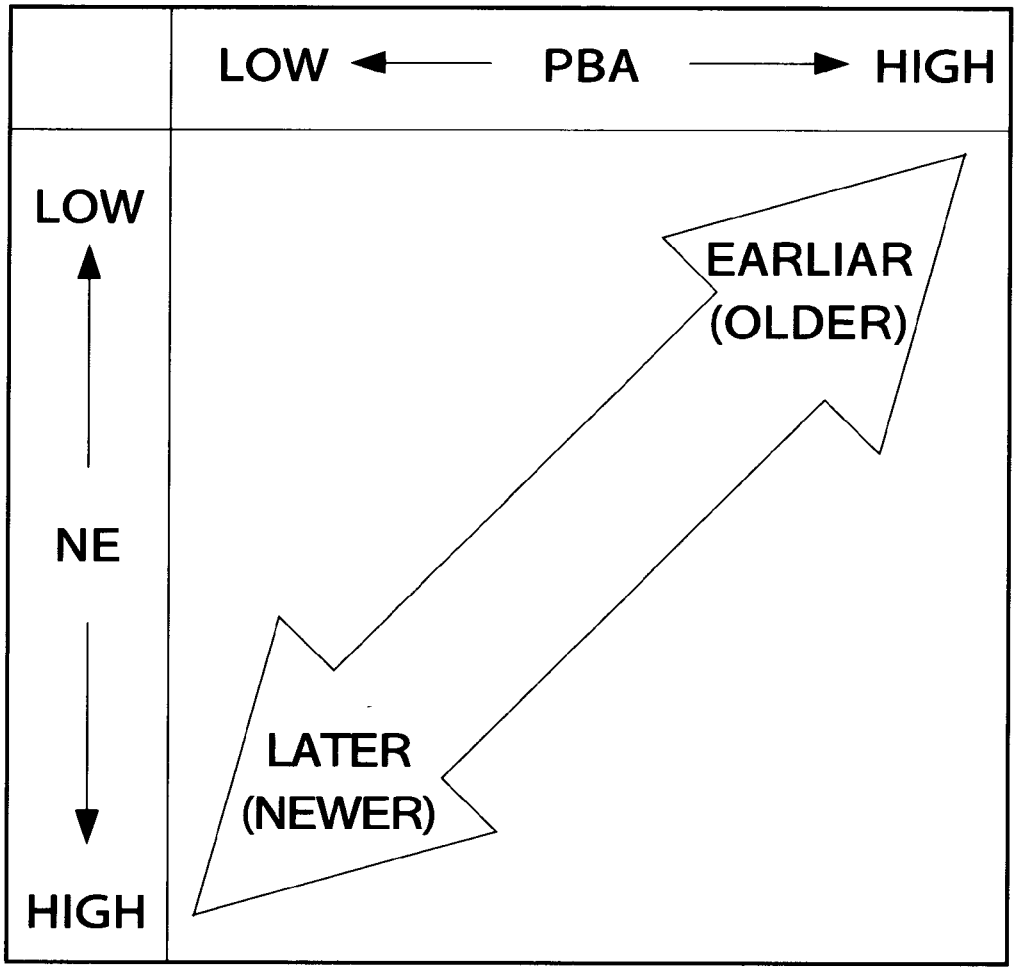
FIG. 8 is a diagram showing characteristics of timing maps used in the FIG. 7 subroutine.
Figure 9A:
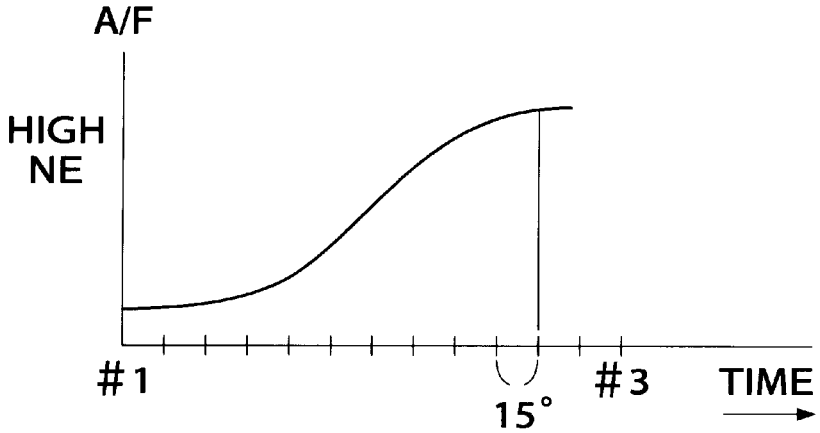
FIG. 9A is a diagram showing characteristics of the output from the LAF sensor assumed at a high engine rotational speed, which is useful in explaining the characteristics of the timing maps shown in FIG. 8.
Figure 9B:
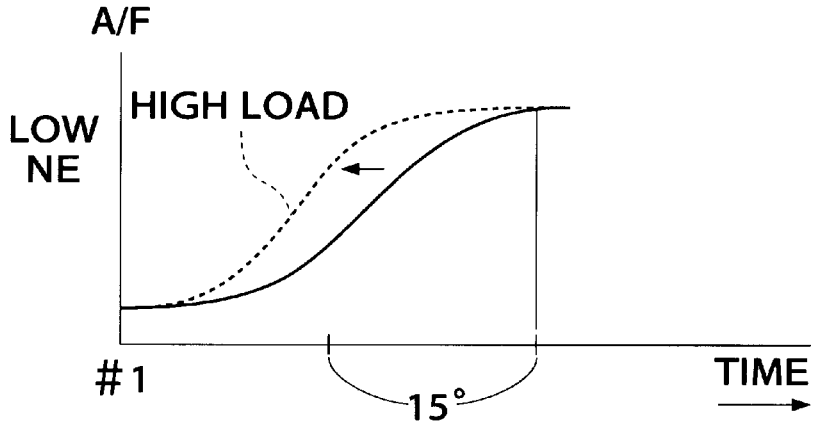
FIG. 9B is a diagram showing characteristics of the output from the LAF sensor assumed at a low engine rotational speed with a shift to be effected when a change in load on the engine occurs, which is useful in explaining the characteristics of the timing maps shown in FIG. 8.

The timing maps are set e.g. as shown in FIG. 8 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that, as shown in FIGS. 5A and 5B referred to before, the air-fuel ratio is best sampled at timing closest to time points corresponding to maximal and minimal values (hereinafter both referred to as "extreme values" of the actual air-fuel ratio), and assuming that the response time (delay of response) of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIGS. 9A and 9B.

As described above, according to the FIG. 7 process, the sensor output VLAF value sampled at the optimum timing is selected depending on operating conditions of the engine, which improves the accuracy of detection of the air-fuel ratio. As a result, a cylinder-by-cylinder value of the air-fuel ratio can be estimated by the observer with enhanced accuracy, leading to improved accuracy of the air-fuel ratio feedback control for each cylinder.

Figure 10:
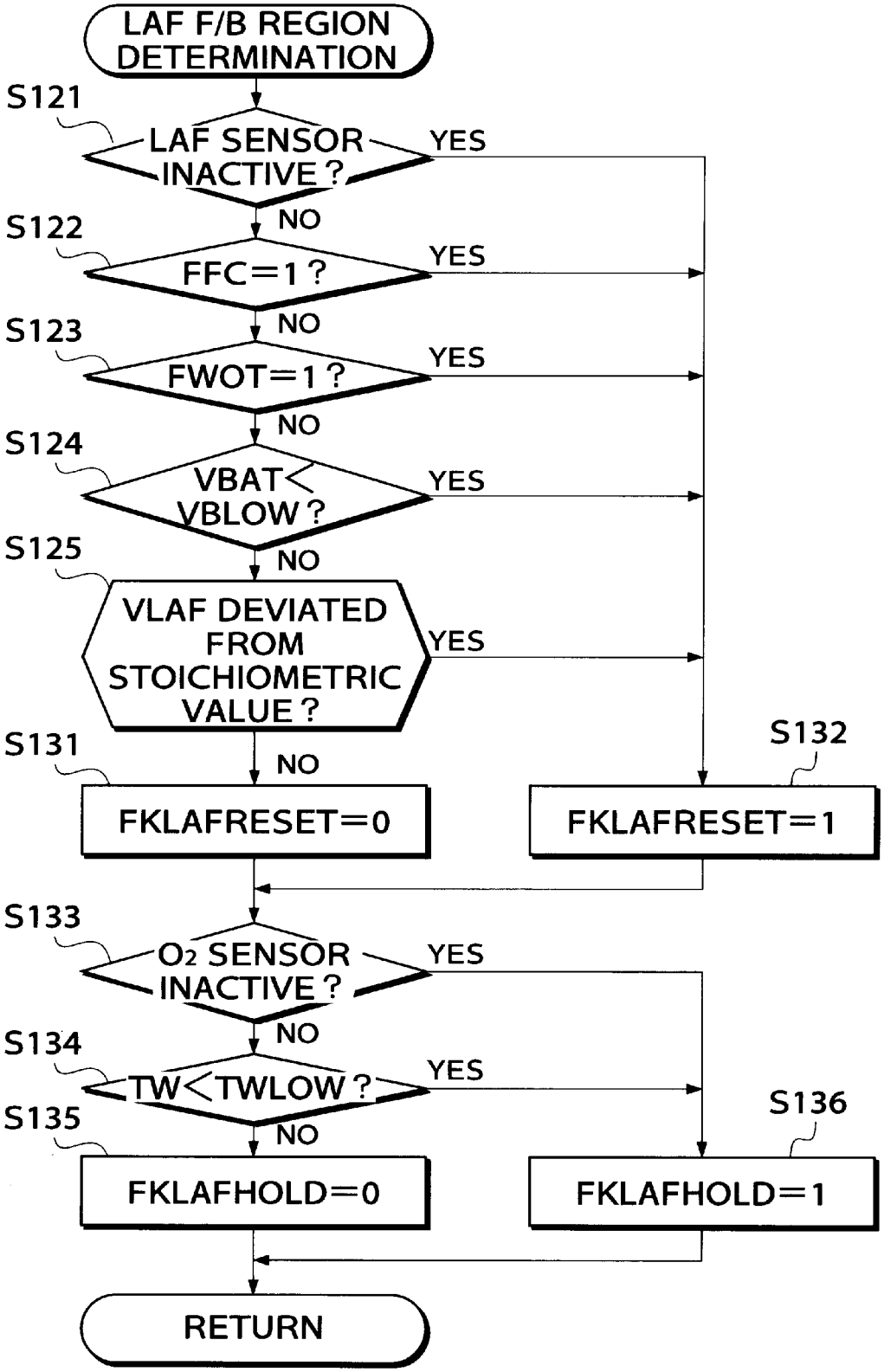
FIG. 10 is a flowchart showing a subroutine for determining whether the engine is operating in an LAF feedback control region, which is executed at a step S6 in FIG. 3.

FIG. 10 shows a subroutine for carrying out a LAF feedback control region-determining process, which is executed at the step S6 in FIG. 3.

First, at a step S121, it is determined whether or not the LAF sensor 17 is inactive. If the LAF sensor 17 is active, it is determined at a step S122 whether or not a flag FFC which, when set to "1", indicates that fuel cut is being carried out, assumes "1". If FFC=0 holds, it is determined at a step S123 whether or not a flag FWOT which, when set to "1", indicates that the engine is operating in a wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from a proper value corresponding to a stoichiometric air-fuel ratio (LAF sensor output deviation). If any of the answers to the questions of the steps S121 to S125 is affirmative (YES), the reset flag FKLAFRESET is set to "1" at a step S132.

On the other hand, if all the answers to the questions of the steps S121 to S125 are negative (NO), it is determined that the feedback control based on the LAF sensor output can be carried out, and then the reset flag FKLAFRESET is set to "0" at a step S131.

At the following step S133, it is determined whether or not the O2 sensor 18 is inactive. If the O2 sensor 18 is active, it is determined at a step S134 whether or not the engine coolant temperature TW is lower than a predetermined lower limit value TWLOW (e.g. 0° C). If the O2 sensor 18 is inactive or if TW<TWLOW holds, a hold flag FKLAFHOLD which, when set to "1", indicates that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, description will be made of the manner of calculation of the cylinder-by-cylinder correction coefficient KOBSV#N executed at the step S9 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), and (k+2) are expressed by equations (2A), (2B), and (2C), respectively. In preparing these equations, the fuel amount (F) was used as an operation amount, and accordingly the fuel-air ratio F/A is used in these equations:

$$[F/A](k) = C_1[F/A\#1] + C_2[F/A\#3] + C_3[F/A\#4] + C_4[F/A\#2] \tag{2A}$$

$$[F/A](k+1) = C_1[F/A\#3] + C_2[F/A\#4] + C_3[F/A\#2] + C_4[F/A\#1] \tag{2B}$$

$$[F/A](k+2) = C_1[F/A\#4] + C_2[F/A\#2] + C_3[F/A\#1] + C_4[F/A\#3] \tag{2C}$$

Figure 11:
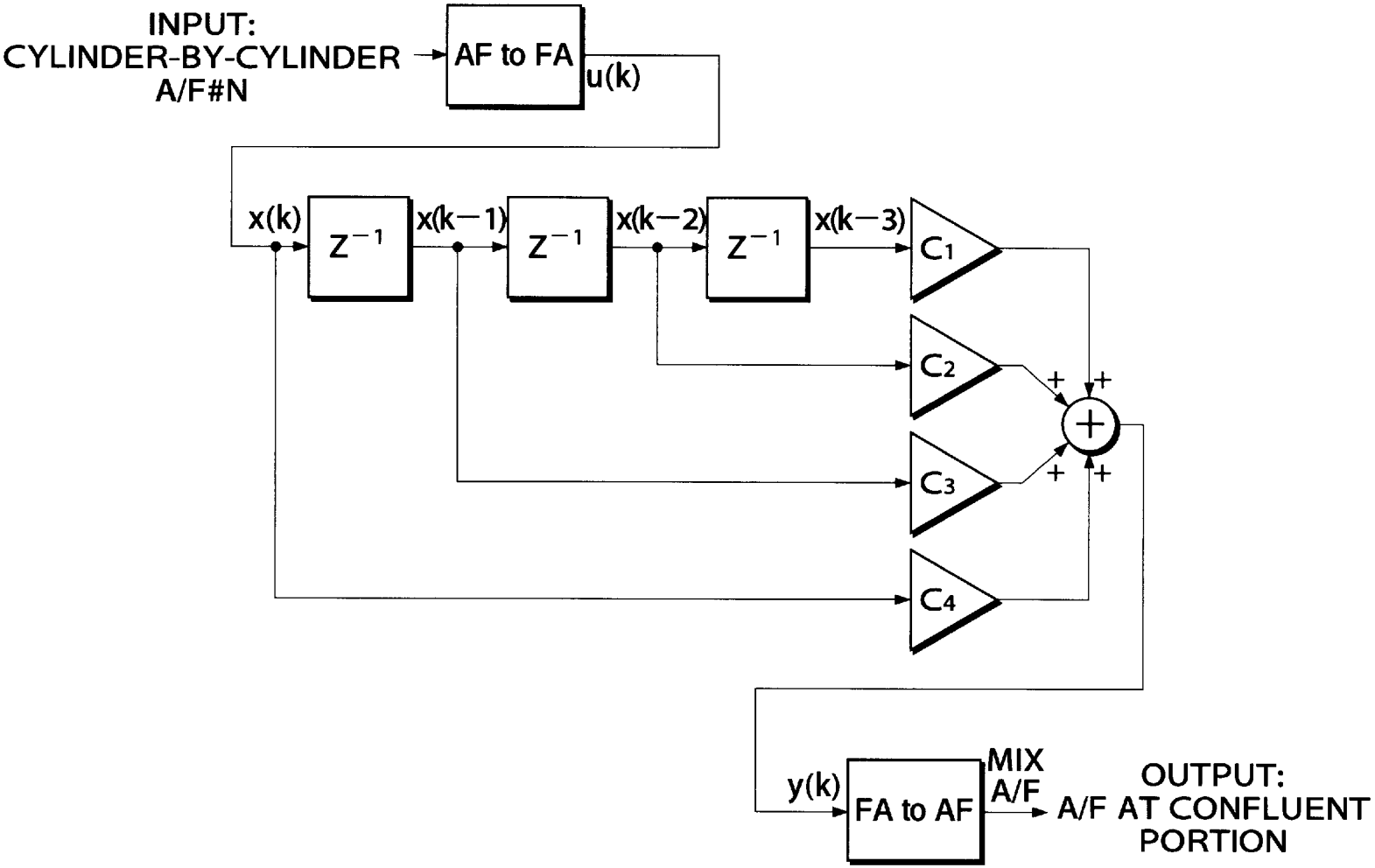
FIG. 11 is a block diagram showing a model representative of the behavior of the exhaust system of the engine.
Figure 12:
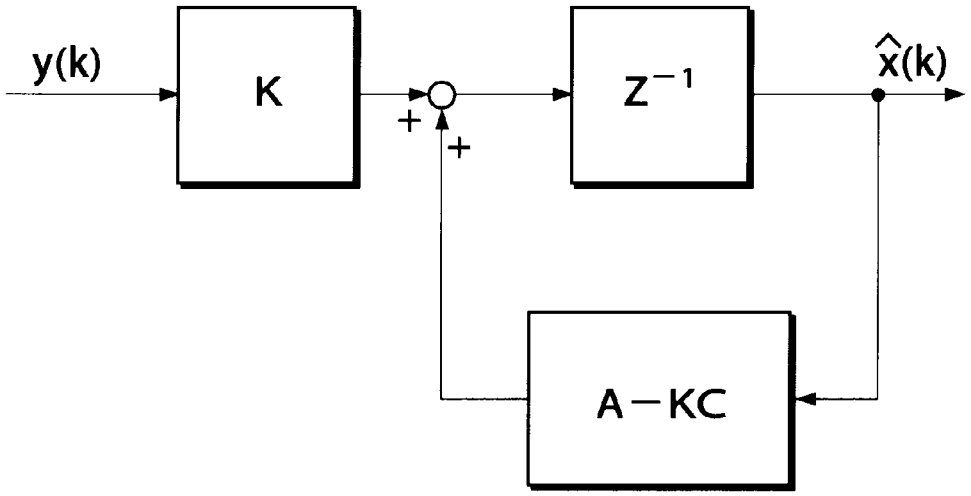
FIG. 12 is a block diagram showing the construction of an observer, which is applied to the model of the exhaust system.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 11, and the state equation therefor is expressed by the following equation (3):

$$\begin{bmatrix} x(k-2) \\ x(k-1) \\ x(k) \end{bmatrix} = \begin{bmatrix} 0 & 1 & 0 \\ 0 & 0 & 1 \\ 0 & 0 & 0 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{3}$$

Further, if the fuel-air ratio detected at the confluent portion is designated by y(k), the output equation can be expressed by the following equation (4):

$$y(k) = [\, c_1 \quad c_2 \quad c_3 \,] \begin{bmatrix} x(k-3) \\ x(k-2) \\ x(k-1) \end{bmatrix} + c_4 u(k) \tag{4}$$

where, $c_1$: 0.05, $c_2$: 0.15, $c_3$: 0.30, $c_4$: 0.50.

In the equation (4), u(k) cannot be observed, and hence an observer designed based on this state equation cannot perform observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following equation (5):

$$\begin{bmatrix} x(k-2) \\ x(k-1) \\ x(k) \\ x(k+1) \end{bmatrix} = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \begin{bmatrix} x(k-3) \\ x(k-2) \\ x(k-1) \\ x(k) \end{bmatrix} \tag{5}$$

$$y(k) = [\, c_1 \quad c_2 \quad c_3 \quad c_4 \,] \begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$\begin{bmatrix} X(k+1) = AX(k) + Bu(k) \\ y(k) = CX(k) + Du(k) \end{bmatrix} \tag{6}$$

where $$A = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \quad C = [\, c_1 \quad c_2 \quad c_3 \quad c_4 \,] \quad B = D = 0$$

$$X(k) = \begin{bmatrix} x(k-3) \\ x(k-2) \\ x(k-1) \\ x(k) \end{bmatrix}$$

$$Q = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \quad R = [1] \tag{7}$$

$$K = \begin{bmatrix} -0.3093 \\ 1.1916 \\ 0.3093 \\ 0.0803 \end{bmatrix} \tag{8}$$

In the model of the present embodiment, there is no inputting of u(k) which is input to an observer of a general type, so that the observer of the present embodiment is constructed such that y(k) alone is input thereto as shown in FIG. 11, which is expressed by the following equation (9):

$$\hat{X}(k+1) = [A - KC]\hat{X}(k) + Ky(k) = A\hat{X}(k) + K\left(y(k) - C\hat{X}(k)\right) \quad (9)$$

$$\hat{x}(k) = \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value X Λ(k) of the cylinder-by-cylinder fuel-air ratio obtained in the past, the estimated value x Λ(k+1) of the same in the present loop can be calculated.

When the above equation (9) is employed to calculate the cylinder-by-cylinder fuel-air ratio X Λ(k+1), the actual equivalent ratio KACT(k) is substituted for the fuel-air ratio y(k) at the confluent portion. However, the actual equivalent ratio KACT(k) contains the response delay of the LAF sensor 17, whereas the CX Λ(k) value (weighted sum of four cylinder-by-cylinder fuel-air ratio values) does not contain the response delay. Therefore, the cylinder-by-cylinder fuel-air ratio cannot be accurately estimated by the use of the equation (9), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value y Λ(k) of the fuel-air ratio at the confluent portion is calculated by the use of the following equation (10), and the thus calculated value y Λ(k) is applied to the following equation (11), to thereby calculate the estimated value X Λ(k+1) of the cylinder-by-cylinder fuel-air ratio:

$$\hat{y}(k)=DL\hat{y}(k-1)+(1-DL)C\hat{X}(k) \ldots \quad (10)$$

$$\hat{X}(k+1)=A\hat{X}(k)+K(y(k)-\hat{y}(k)) \ldots \quad (11)$$

Figure 13:
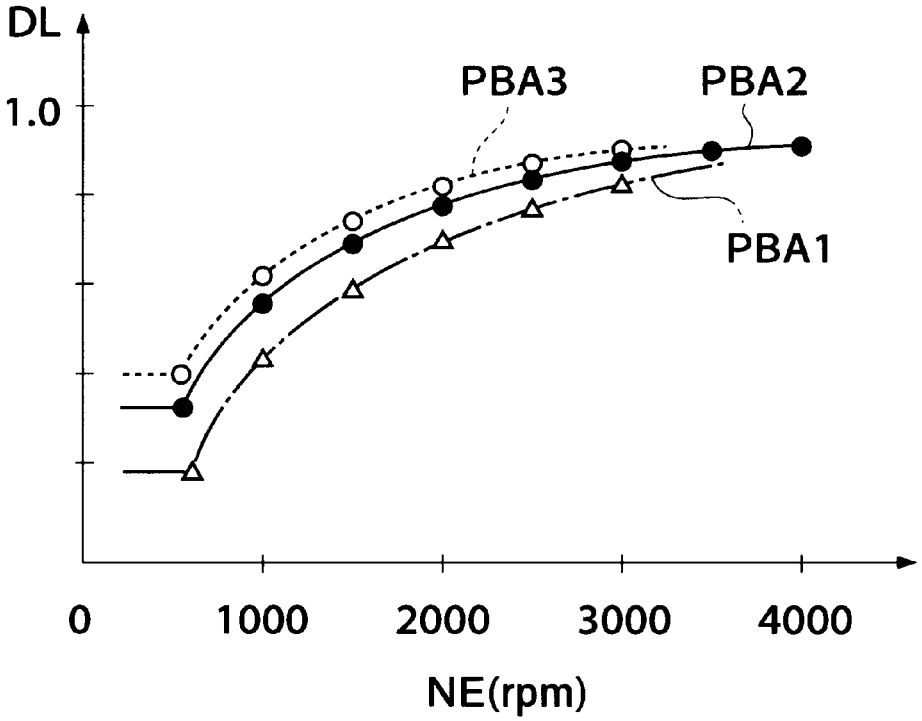
FIG. 13 shows a table for determining a response delay time constant DL for the LAF sensor.
Figure 14:
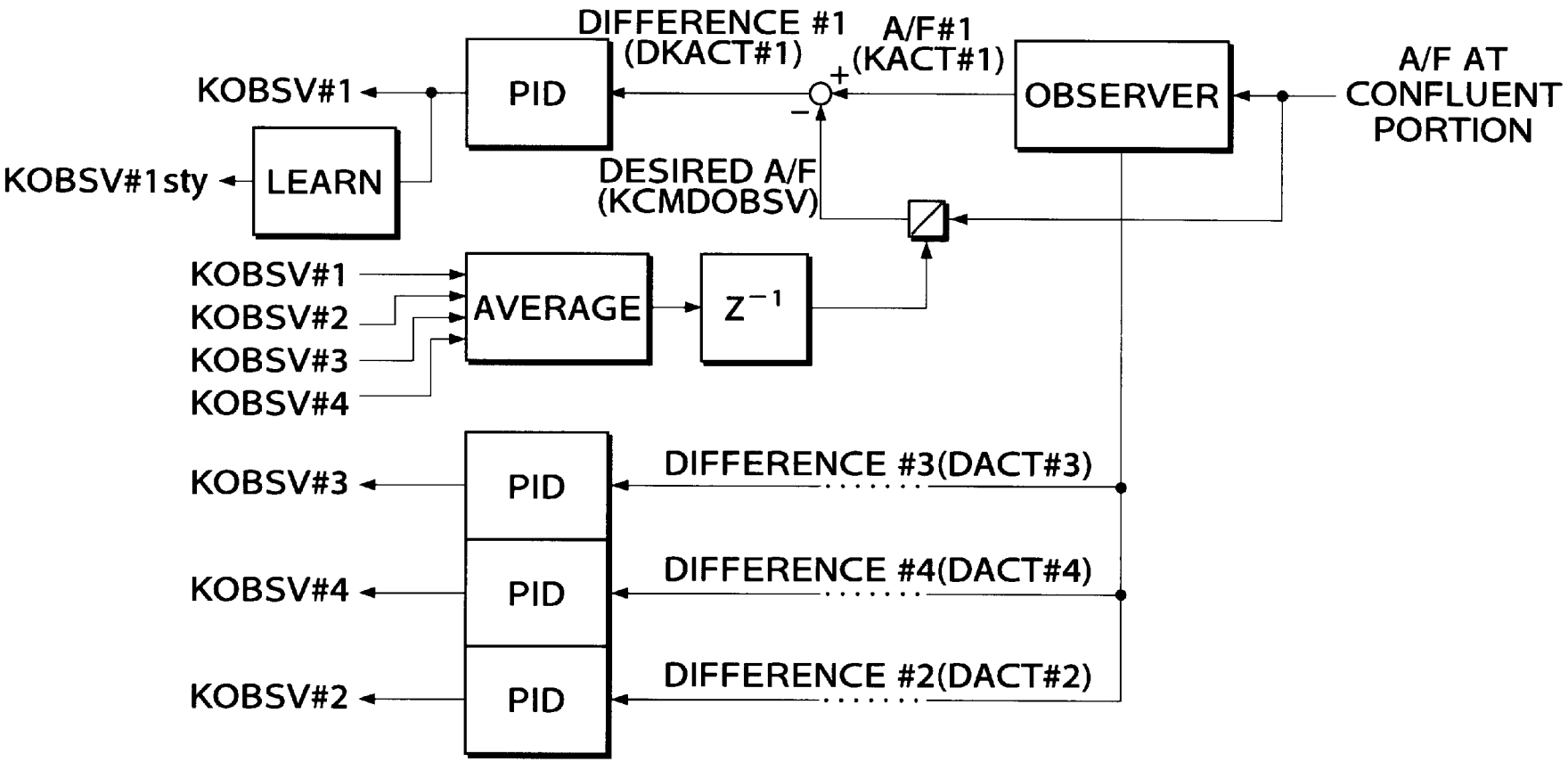
FIG. 14 is a diagram which is useful in explaining a manner of cylinder-by-cylinder air-fuel ratio feedback control.

In the above equation (10), DL represents a parameter corresponding to a time constant of the response delay of the LAF sensor 17, which is determined from a DL table shown in FIG. 13. The DL table is set such that the DL value is set to a value between 0 to 1.0 according to the engine rotational speed NE and the intake pipe absolute pressure PBA. In the figure, PBA1 to PBA3 represent 660 mmHg, 460 mmHg, and 260 mmHg, respectively and an interpolation is carried out when the NE and/or PBA value falls between the predetermined values. It has been empirically ascertained that the best compensation for the response delay of the LAF sensor 17 can be obtained if the time constant DL is set to a value corresponding to a time period longer than the actual response delay by approximately 20%.

Conventionally, the X Λ(k) value in the above equations (10) and (11) has an initial vector thereof set such that component elements thereof (x Λ(k−3), x Λ(k−2), x Λ(k−1)) all assume 1.0 (a value corresponding to the stoichiometric air-fuel ratio), and an initial value of the estimated value y Λ(k−1) in the equation (10) has been set to 1.0. According to the present embodiment, however, the initial vector of the the X Λ(k) is set such that the component elements are equal to the actual equivalent ratio KACT(k) and the initial value of the y Λ(k−1) is set to the actual equivalent ratio KACT(k), as described hereinafter.

By thus using the equation (11) which is obtained by replacing the CX Λ(k) in the equation (9) by the estimated value y Λ(k) of the fuel-air ratio at the confluent portion containing the response delay, the response delay of the LAF sensor can be properly compensated for, to thereby carry out accurate estimation of the cylinder-by-cylinder air-fuel ratio. Especially, the estimation by the cylinder-by-cylinder air-fuel ratio-estimating system of the present embodiment is less susceptible to the influence of noises compared with the estimation by the conventional system. In the following description, estimated equivalent ratio values KACT#1(k) to KACT#4(k) for the respective cylinders correspond to the x Λ(k) value.

Next, description will be made of the manner of calculating the cylinder-by-cylinder correction coefficient KOBSV#N, based on the thus estimated cylinder-by-cylinder air-fuel ratio, with reference to FIG. 13.

As shown in the following equation (12), the actual equivalent ratio KACT corresponding to the air-fuel ratio A/F at the confluent portion is divided by the immediately preceding value of an average value of the cylinder-by-cylinder correction coefficient KOBSV#N for all the cylinders, to thereby calculate a desired value KCMDOBSV (k) as an equivalent ratio corresponding to the desired air-fuel ratio. The cylinder-by-cylinder correction coefficient KOBSV#1 for the #1 cylinder is calculated by the PID control such that the difference DKACT#1(k)(=KACT#1 (k)−KCMDOBSV(k)) between the desired value KCMDOBSV(k) and the estimated equivalent ratio KACT#1(k) for the #1 cylinder becomes equal to zero:

$$KCMDOBSV(k) = KACT(k) \Big/ \left( \sum_{N=1}^{4} KOBSV\#N(k-1)/4 \right) \quad (12)$$

More specifically, a proportional term KOBSVP#1, an integral term KOBSVI#1, and a differential term KOBSVD#1 for use in the PID control are calculated by the use of the respective following equations (13A), (13B), and (13C), to thereby calculate the cylinder-by-cylinder correction coefficient KOBSV#1 by the use of the following equation (14):

$$KOBSVP\#1(k)=KPOBSV\times DKACT\#1(K) \ldots \quad (13A)$$

$$KOBSVI\#1(k)=KIOBSV\times DKACT\#1(K)+KOBSVI\#1(k-1) \ldots \quad (13B)$$

$$KOBSVD\#1(k)=KDOBSV\times(DKACT\#1(K)-DKACT\#1(k-1)) \quad (13C)$$

$$KOBSV\#1(k)=KOBSVP\#1(k)+KOBSVI\#1(k)+KOBSVD\#1(k)+1.0 \ldots \quad (14)$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, the learned value KOBSV#Nsty of the cylinder-by-cylinder correction coefficient KOBSV#N is calculated by the use of the following equation (15) and stored:

$$KOBSV\#Nsty=Csty\times KOBSV\#N+(1-Csty)\times KOBSV\#Nsty \quad (15)$$

where Csty represents a weighting coefficient, and KOBSV#Nsty on the right side the immediately preceding learned value.

Figure 15:
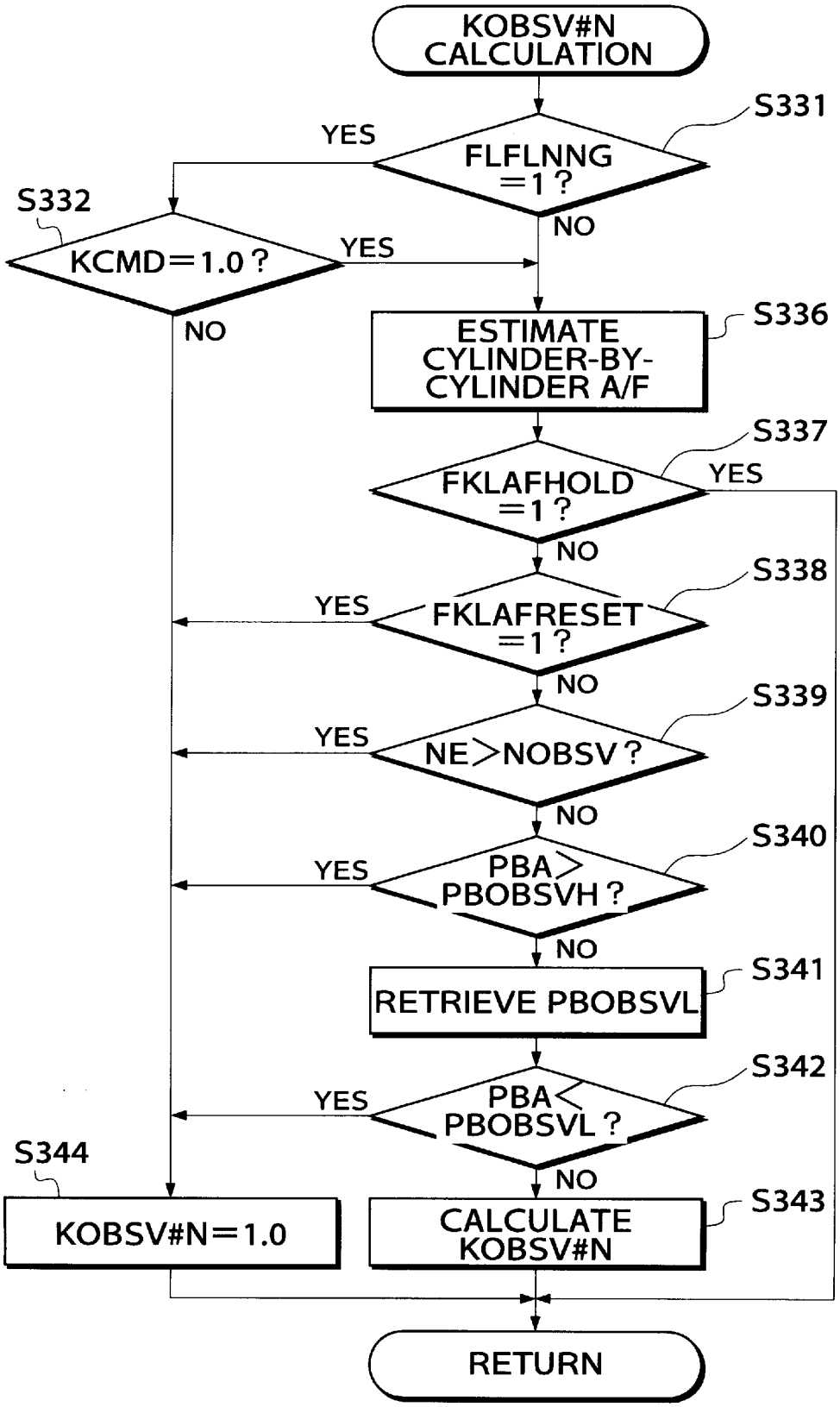
FIG. 15 is a flowchart showing a subroutine for calculating the cylinder-by-cylinder correction coefficient KOBSV#N, which is executed at a step S9 in FIG. 3.

FIG. 15 shows a subroutine for calculating the cylinder-by-cylinder correction coefficient KOBSV#N, which is executed at the step S9 in FIG. 3.

First, at a step S331, it is determined whether or not lean output deterioration of the LAF sensor 17 has been detected, and if the lean output deterioration has not been detected, the program proceeds to a step S336. On the other hand, if the lean output deterioration has been detected, it is determined at a step S332 whether or not the desired equivalent ratio KCMD is equal to 1.0, i.e. whether or not the desired air-fuel ratio assumes the stoichiometric air-fuel ratio. The lean output deterioration of the LAF sensor means such a deterioration of the LAF sensor that the output from the LAF sensor exhibited when the air-fuel ratio of the mixture is actually controlled to a value leaner than the stoichiometric value deviates from a proper value by an amount larger than a predetermined amount. If KCMD=1.0 holds, the program proceeds to the step S336, whereas if KCMD≠1.0 holds, the cylinder-by-cylinder correction coefficient KOBSV#N for all the cylinders is set to 1.0 at a step S344, which means that the cylinder-by-cylinder feedback control is not executed, followed by terminating the present routine.

At the step S336, the cylinder-by-cylinder air-fuel ratio estimation by the observer described above is executed. Then, it is determined at a step S337 whether or not the hold flag FKLAFHOLD assumes "1". If FKLAFHOLD=1 holds, the program is immediately terminated.

Figure 17:
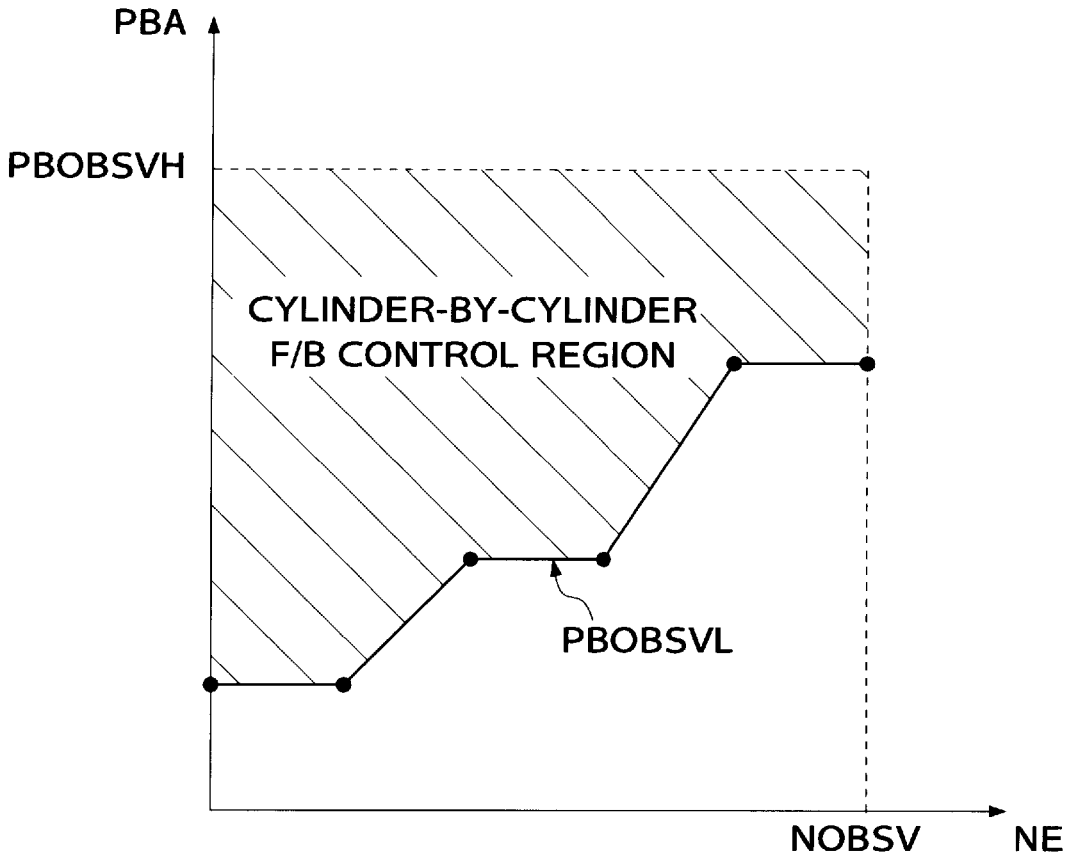
FIG. 17 is a diagram which is useful in explaining a cylinder-by-cylinder feedback control region.

If FKLAFHOLD=0 holds at the step S337, it is determined at a step S338 whether or not the reset flag FKLAFRESET assumes "1". If FKLAFRESET=0 holds, it is determined at a step S339 whether or not the engine rotational speed NE is higher than a predetermined value NOBSV (e.g. 3500 rpm). If NE≦NOBSV holds, it is determined at a step S340 whether or not the intake pipe absolute pressure PBA is higher than a predetermined upper limit value PBOBSVH (e.g. 650 mmHg). If PBA≦PBOBSVH holds, a PBOBSVL table which is set according to the engine rotational speed NE, as shown in FIG. 17, is retrieved to determine a lower limit value PBOBSVL of the PBA value at a step S341, and then it is determined at a step S342 whether or not the PBA value is lower than the lower limit value PBOBSVL.

If any of the answers to the questions of the steps S338 to S340 and S342 is affirmative (YES), the program proceeds to the step S344, and therefore the cylinder-by-cylinder air-fuel ratio feedback control is not executed. On the other hand, if the answers to the questions of the steps S338 to S340 and S342 are all negative (NO), which means that the engine is in a operating condition corresponding to the shaded region in FIG. 17, it is determined that the cylinder-by-cylinder air-fuel ratio feedback control can be carried out. Therefore, the cylinder-by-cylinder correction coefficient KOBSV#N is calculated in the manner as described above at a step S343, followed by terminating the present program.

Figure 16:
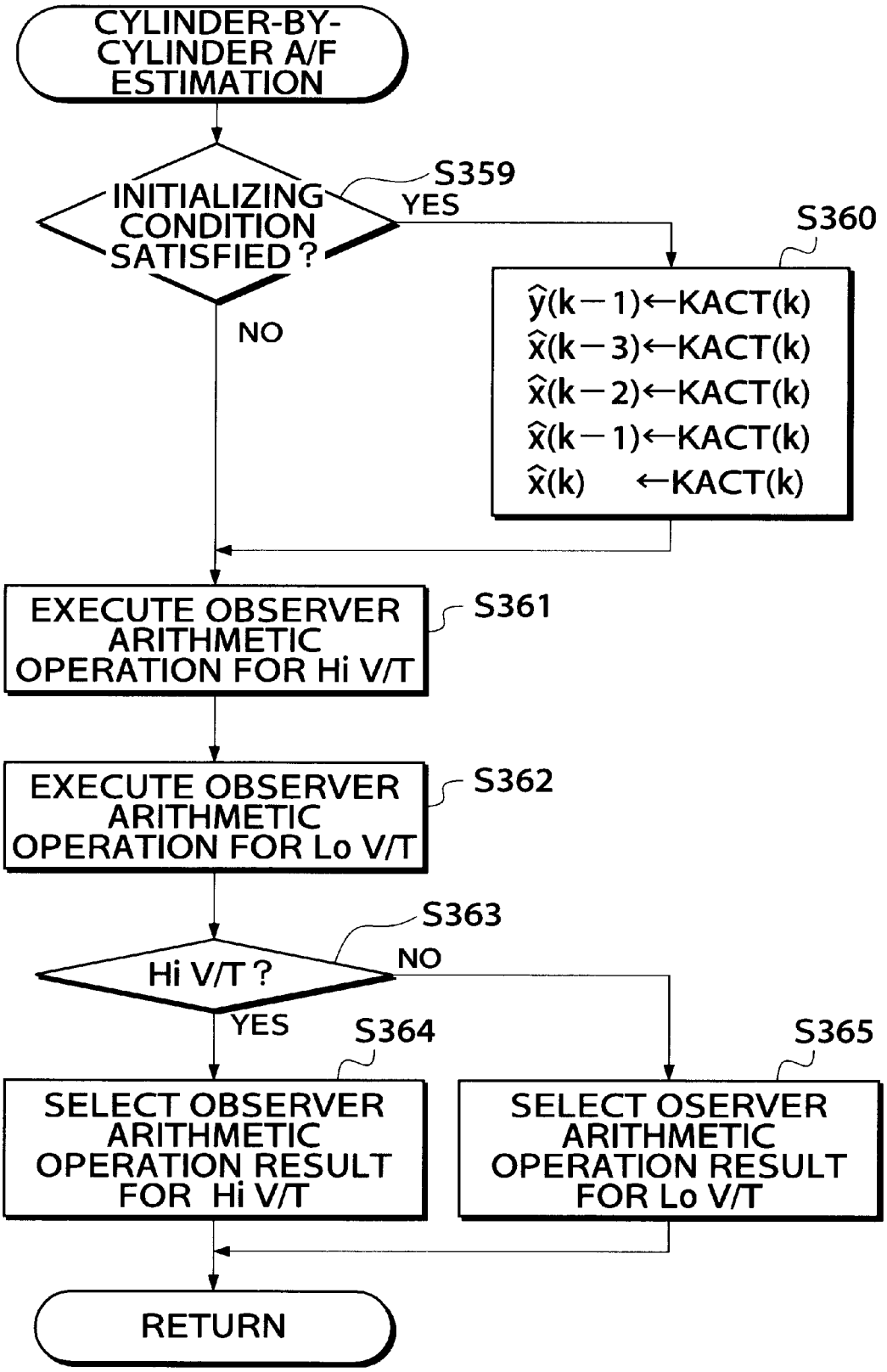
FIG. 16 is a flowchart showing a subroutine for carrying out a cylinder-by-cylinder air-fuel ratio-estimating process, which is executed at a step S336 in FIG. 15.

FIG. 16 shows a subroutine for estimating the cylinder-by-cylinder air-fuel ratio, which is executed at the step S336 in FIG. 15.

At a step S359, it is determined whether or not an initializing condition is satisfied. The initializing condition is satisfied, e.g. when the cylinder-by-cylinder air-fuel ratio feedback control is started, the engine operating condition shifts to a fuel-cut state or returns from the fuel-cut state (the fuel supply is resumed), or the engine operating condition shifts from an idling condition to a condition other than the idling condition, or vice versa.

If the initializing condition is not satisfied, the program skips over a step S360 to a step S361, whereas if it is satisfied, the program proceeds to the step S360. At the step S360, the $y\Lambda(k-1)$ value in the equation (10) and the component elements $x\Lambda(k-3)$, $x\Lambda(k-2)$, $x\Lambda(k-1)$ and $x\Lambda(k)$ of the $X\Lambda(k)$ value in the equations (10) and (11) are all initialized to the actual equivalent ratio KACT(k), followed by the program proceeding to the step S361.

By virtue of this initialization, the converging speed of the observer can be enhanced when the engine is in a transient operating condition, such as when the cylinder-by-cylinder air-fuel ratio feedback control is started, or the engine operating condition shifts to a fuel-cut state or returns from the fuel-cut state. As a result, even in such a transient operating condition, stable cylinder-by-cylinder air-fuel ratio values can be obtained. Thus, the cylinder-by-cylinder air-fuel ratio control can be properly carried out, to thereby prevent degraded exhaust emission characteristics and degraded fuel economy.

The converging speed of the observer can be enhanced even by increasing the gain K of the observer. When the gain K is increased to a too large value, however, the estimated air-fuel ratio becomes unstable. The initialization of the estimated air-fuel ratio according to the present embodiment can avoid such an unstable estimated air-fuel ratio.

At a step S361, an arithmetic operation by the use of the observer (i.e. estimation of the cylinder-by-cylinder air-fuel ratio value) for the high-speed valve timing is carried out, and at the following step S362, an arithmetic operation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

What is claimed is:

1. In a cylinder-by-cylinder air-fuel ratio-estimating system for an internal combustion engine having a plurality of cylinders, and an exhaust system, the cylinder-by-cylinder air-fuel ratio-estimating system including air-fuel ratio-detecting means arranged in said exhaust system, and cylinder-by-cylinder air-fuel ratio-estimating means for estimating an air-fuel ratio of a mixture supplied to each of said cylinders, based on an output from said air-fuel ratio-detecting means, by using an observer for observing an internal operative state of said exhaust system based on a model representative of a behavior of said exhaust system, the improvement wherein:

said cylinder-by-cylinder air-fuel ratio-estimating means includes first initializing means for initializing said air-fuel ratio of said mixture supplied to said each of said cylinders estimated by said cylinder-by-cylinder air-fuel ratio-estimating means to a value corresponding to said output from said air-fuel ratio-detecting means, depending upon operating conditions of said engine.

2. A cylinder-by-cylinder air-fuel ratio-estimating system as claimed in claim 1, wherein said exhaust system includes at least one confluent portion, said air-fuel ratio-detecting means being arranged at said confluent portion of said exhaust system.

3. A cylinder-by-cylinder air-fuel ratio-estimating system as claimed in claim 2, wherein said cylinder-by-cylinder air-fuel ratio-estimating means includes confluent portion air-fuel ratio-estimating means for estimating an air-fuel ratio at said confluent portion of said exhaust system by using a delay parameter representative of a response delay of said air-fuel ratio-detecting means, said confluent portion air-fuel ratio-estimating means including second initializing means for initializing said air-fuel ratio at said confluent portion estimated by said confluent portion air-fuel ratio-estimating means to a value corresponding to said output from said air-fuel ratio-detecting means, depending upon said operating conditions of said engine.

4. A cylinder-by-cylinder air-fuel ratio-estimating system as claimed in any of claims 1 to 3, wherein said first and second initializing means are operable when said engine is in a predetermined transient operating condition.

5. A cylinder-by-cylinder air-fuel ratio-estimating system as claimed in claim 4, wherein said predetermined transient condition of said engine is an operating condition in which cylinder-by-cylinder air-fuel ratio feedback control is started, said cylinder-by-cylinder air-fuel ratio feedback control feedback-controlling said air-fuel ratio of said mixture supplied to said each of said cylinders to a desired air-fuel ratio, based on said air-fuel ratio of said mixture supplied to said each of said cylinders estimated by said cylinder-by-cylinder air-fuel ratio-estimating means and said air-fuel ratio at said confluent portion estimated by said confluent portion air-fuel ratio-estimating means.

6. A cylinder-by-cylinder air-fuel ratio-estimating system as claimed in claim 4, wherein said predetermined transient operating condition of said engine is an operating condition in which said engine has shifted to a fuel-cut state or has returned from said fuel-cut state.

7. A cylinder-by-cylinder air-fuel ratio-estimating system as claimed in claim 4, wherein said predetermined transient operating condition of said engine is an operating condition in which said engine has shifted to an idling condition or has shifted from said idling condition to a condition other than said idling condition.

* * * * *